US010085920B2

(12) United States Patent
Fan

(10) Patent No.: US 10,085,920 B2
(45) Date of Patent: Oct. 2, 2018

(54) VENTED BABY BOTTLE

(71) Applicant: Benir Baby, LTD, Hong Kong (HK)

(72) Inventor: Chow Kai Fan, Shatin (HK)

( * ) Notice: Subject to any disclaimer, the term of this patent is extended or adjusted under 35 U.S.C. 154(b) by 418 days.

(21) Appl. No.: 14/641,600

(22) Filed: Mar. 9, 2015

(65) Prior Publication Data

US 2016/0262985 A1 Sep. 15, 2016

(51) Int. Cl.
*A61J 9/04* (2006.01)
*A61J 9/06* (2006.01)

(52) U.S. Cl.
CPC ..... *A61J 9/04* (2013.01); *A61J 9/0623* (2015.05)

(58) Field of Classification Search
CPC ... A61J 9/04; A61J 11/02; A61J 11/045; A61J 11/04; A61J 9/00
USPC ..... 215/11.1–11.6, 12.1, 902; 222/481
See application file for complete search history.

(56) References Cited

U.S. PATENT DOCUMENTS

| | | | | |
|---|---|---|---|---|
| 3,168,221 | A | 2/1965 | Parker | |
| 4,940,152 | A | 7/1990 | Lin | |
| 4,994,076 | A | 2/1991 | Guss | |
| 5,570,796 | A | 9/1996 | Brown et al. | |
| 5,779,071 | A | 7/1998 | Brown et al. | |
| 6,499,615 | B1 * | 12/2002 | Szieff | A61J 9/00 215/11.1 |
| 7,326,234 | B2 | 2/2008 | Lieberman et al. | |
| 7,810,661 | B2 * | 10/2010 | Murphy | A61J 9/00 206/219 |
| 7,828,165 | B2 | 11/2010 | Brown et al. | |
| 8,113,365 | B2 | 2/2012 | Brown et al. | |
| 8,146,759 | B2 | 4/2012 | Brown et al. | |
| 8,479,934 | B2 | 7/2013 | Brown et al. | |
| 8,579,130 | B2 | 11/2013 | Brown et al. | |
| 8,757,406 | B2 | 6/2014 | Brown et al. | |
| 2006/0071925 | A1 * | 4/2006 | Wykoff | G06F 3/147 345/211 |

(Continued)

FOREIGN PATENT DOCUMENTS

| | | | | |
|---|---|---|---|---|
| EP | 2133061 | A2 * | 12/2009 | A61J 9/04 |
| WO | WO 2005112869 | A1 * | 12/2005 | A61J 9/006 |
| WO | WO 2008123744 | A1 * | 10/2008 | A61J 9/04 |

OTHER PUBLICATIONS

Tod Von Mechow, Bottle Attributes—Soda & Mineral Water Bottle Closures, webpage, Oct. 26, 2014, www.sodasandbeers.com/SABBottleClosuresSoda.htm.

(Continued)

*Primary Examiner* — Fenn C Mathew
*Assistant Examiner* — Cynthia Collado
(74) *Attorney, Agent, or Firm* — Hultman Law, PLC; Eric Andrew Hultman, Esq.

(57) ABSTRACT

A vented baby bottle (28) is disclosed herein and comprises a bottle (30), a nipple (32), a mounting ring (34), and a vent assembly (36). The principle advantage offered by this invention includes decreasing aeration (gas bubbles) in the bottle's fluid by establishing an air passage (168) through the mounting ring into the interior (48) of the bottle. When this air passage is used in combination with a vent assembly having a self closing vent valve (132), the system allows atmospheric air to vent into the interior of the baby bottle when a lower than atmospheric pressure is created within the bottle, thereby preventing the aeration of the fluid contained in the bottle.

20 Claims, 22 Drawing Sheets

(56) References Cited

U.S. PATENT DOCUMENTS

| | | | | |
|---|---|---|---|---|
| 2006/0213859 | A1* | 9/2006 | Sheu | A61J 9/006 215/11.5 |
| 2009/0071926 | A1* | 3/2009 | Berkovitch | A61J 9/04 215/11.4 |
| 2011/0011819 | A1* | 1/2011 | Lee | A61J 9/006 215/11.5 |
| 2011/0079570 | A1 | 4/2011 | Brown et al. | |
| 2011/0233236 | A1 | 9/2011 | Brown et al. | |
| 2016/0354287 | A1* | 12/2016 | Britto | A61J 11/02 |

OTHER PUBLICATIONS

Tod Von Mechow, Bottle Attributes—Beer Bottle Closures, webpage, Oct. 26, 2014. www.sodasandbeers.com/SABBottleClosuresBeer.htm.

* cited by examiner

VENTED BABY BOTTLE

BACKGROUND OF THE INVENTION

Field of the Invention

The present invention generally relates to containers for dispensing liquids, more specifically baby bottles, and particularly to baby bottles that contain a venting system.

Description of the Related Art

Prior art baby bottles are typically comprised of a liquid storage container or bottle, a pliable nipple or teat containing a dispensing orifice, and a mounting ring used for attaching and sealing the nipple to the bottle. The prior art bottles are used by filling the bottle with a liquid, passing a portion of the nipple through the mounting ring, and then affixing the mounting ring to the bottle, thereby sealing the nipple against the bottle. This creates a baby bottle containing a single passage into or out of the bottle. This construction limits spills by requiring that all liquids must pass through the nipple's dispensing orifice. This orifice is typically quite small in order to contain the liquid when the container is repositioned or inverted. In order to withdraw the liquid contents from the bottle, the nipple portion of the baby bottle assembly is typically placed into an infant's mouth. The baby's suckling action draws the container's liquid contents through the orifice in the nipple and into their mouth.

Conventional baby bottles are typically air tight, except for the dispensing orifice located in the nipple. Since the bottle is otherwise sealed, as contents are withdrawn from the bottle, a partial vacuum is formed. When the baby stops suckling, suction is removed from the nipple's orifice and air returns to the container through the nipple, equalizing the pressure within the bottle to that of the atmosphere. If the liquid within the container is adjacent to the nipple's orifice when the infant's suction is withdrawn, the incoming air will pass through the container's liquid, aerating the liquid and creating bubbles therein. As the infant resumes suckling, the now aerated liquids and bubbles are drawn through the orifice in the nipple and are ingested by the infant. This is shown to cause digestive discomfort, colic, and even regurgitation of the ingested liquid contents. The invention described herein prevents the creation of air bubbles within the container by providing a novel venting system.

SUMMARY OF THE INVENTION

A vented baby bottle is disclosed herein and comprises a bottle, a nipple, a mounting ring and a vent assembly. The vent assembly further comprises a vent ring, and a vent valve, wherein the vent ring has a body portion, a flange, a liquid passage through both the body and flange, and a vent hole which passes through the body portion. When the vent ring is fitted to the bottle, and the flange positioned adjacent to the top of the bottle, an air passage is formed allowing atmospheric air to pass along the flange into the vent hole. The air passage ends adjacent to the vent valve, wherein the vent valve is positioned from a first position to a second position by creating a lower than atmospheric pressure in the interior volume of the bottle. In the first position, the vent valve blocks the air passage, and in the second position, the passage is opened allowing atmospheric air to enter the interior volume of the said bottle.

In one form, the vented baby comprises a bottle having a top portion forming a hollow container with an interior volume, the top portion and an interior diameter; a nipple; and an annular mounting ring having a body portion and a flanged top; a vent valve; and a vent assembly further comprising: a vent ring having a body, a flange attached to the body, a vent hole passing through the body, and a liquid passage passing through the body and the flange.

The vented bottle is then assembled by fitting the vent ring into the bottle until its flange is positioned adjacent to the top portion of the bottle. This creates an air passage allowing atmospheric air to pass along the flange, into the vent hole, and ending adjacent the vent valve. The vent valve is then positioned into a first or a second position, wherein in the first position it blocks the air passage; and wherein in the second position it allows atmospheric air located in the air passage to pass into the interior of the bottle. The position of the vent valve is controlled via the difference in pressures between the atmosphere and the interior volume of the bottle.

In another form of the invention, the vented baby bottle comprises a bottle, an annular mounting ring, and a vent assembly having a vent ring, a hemispherical shaped vent valve, and a vent tube. The bottle has a concave base portion, curved side walls, and an annular top portion forming a hollow container with an interior volume which is suitable for holding a liquid. The bottle's annular top portion has an external thread, and a single annular shaped opening passing into the interior volume of the bottle. The annular opening further comprises an interior diameter and a smooth wall.

The nipple is constructed of supple material and has a tip, a midsection, and a flanged base. A cavity extends inside the nipple from an interior portion of said tip, through said midsection and passing through said flanged base. The tip portion further comprises a dispensing orifice passing from the interior of the cavity through the tip to the exterior surface of the nipple.

The annular mounting ring has a body portion connected to a flanged top; the interior wall of the body portion is threaded with internal threads which are sized to mate with the bottle's external threads. The annular mounting ring's internal threads further comprise at least one interruption which passes completely from the body portion to a point on the lower surface of the flanged top. An opening is also formed in the flanged top, which is sized to receive and retain said nipple.

The vent ring has a cylindrical body with a circumferential groove having an o-ring. An annular flange is attached to the top of the cylindrical body and includes a vent hole. Adjacent to the vent hole is a channel which passes from an exterior surface of the annular flange to the hole. The vent ring also includes a cylindrical shaped liquid passage passing through the center ring. The annular flange is sized to be diametrically smaller than the bottle's external threads, while also sized to be diametrically larger than the singular annular shaped opening. This difference in size between the exterior surface of the flange and that of the external threads creates a diametrical difference where air may flow.

A hemispherical shaped vent valve is also provided, comprising an inner surface, an outer surface, a dispensing slit, a deformable closure member, and at least one petal shaped protrusion. The dispensing slit passes between the inner and outer surfaces of the vent valve, forming a first wall and second wall within the dispensing slit.

A rigid vent tube is affixed to the vent ring adjacent the vent hole on one end, and is attached to the hemispherical shaped vent valve adjacent to the dispensing slit at the other. The rigid vent tube has an inner diameter and is sized in length to extend into the base portion of the bottle when fully assembled.

The vented baby bottle is assembled by fitting the cylindrical body of the vent ring into the single annular shaped opening in the bottle and depressing it until its annular flange is positioned adjacent to the bottle's annular top portion. The mounting ring's internal threads are then mated to the bottle's external threads, creating an air passage which allows atmospheric air to pass through the interruption in the threads, pass along the diametrical difference between the annular flange and the external threads, pass through the channel, and into the vent ring's vent hole, passing down the inner diameter of the vent tube, and ending adjacent the interior surface of the vent valve's dispensing slit.

The vent valve operates between two positions. When in the first position, the valve is held closed by the deformable closure which places the first wall and the second wall into contact with one another. This blocks the air passage. When in the second position, the first wall and the second wall of the dispensing slit are separated allowing air to pass through the valve into the interior of the bottle. The position of the vent valve is moved from the first position to the second position by creating a lower than atmospheric pressure in said interior volume of the bottle. The vent valve is then returned to the first position by the deformable closure when the pressure is equalized.

BRIEF DESCRIPTION OF THE DRAWING FIGURES

Other advantages of the present invention will be readily understood by reference to the following detailed description in connection with the accompanying drawings wherein.

DESCRIPTION OF THE VARIOUS EMBODIMENTS

Figure 1:
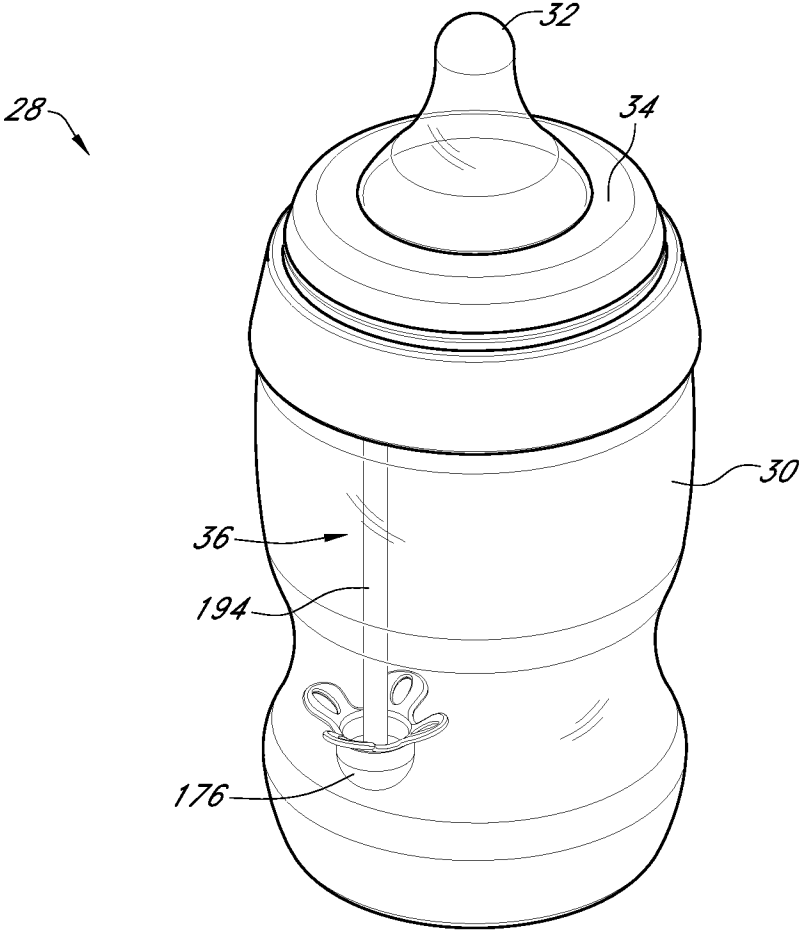
FIG. 1 is a perspective view of a first preferred form of a vented baby bottle.

For purposes of the following description, the terms "upper," "lower," "left," "rear," "front," "vertical," "horizontal," and derivatives of such terms shall relate to the invention as oriented in FIG. 1. However, it is to be understood that the invention may assume various alternative orientations and configuration, except where expressly specified to the contrary. It is also to be understood that the devices illustrated in the attached drawings, and described in the following specification are simply exemplary embodiments of the inventive concepts described herein. Specific dimensions and other physical characteristics relating to the embodiments disclosed herein are not to be considered as limiting unless expressly stated otherwise. Further, the materials described herein are merely exemplary materials suitable for use with the invention and are not intended to be limiting. Hence, the materials described herein may be substituted with any other suitable material such as glass, various plastic compositions, silicone, or rubber. This also includes combinations of the above, including over-molded components.

Figure 2:
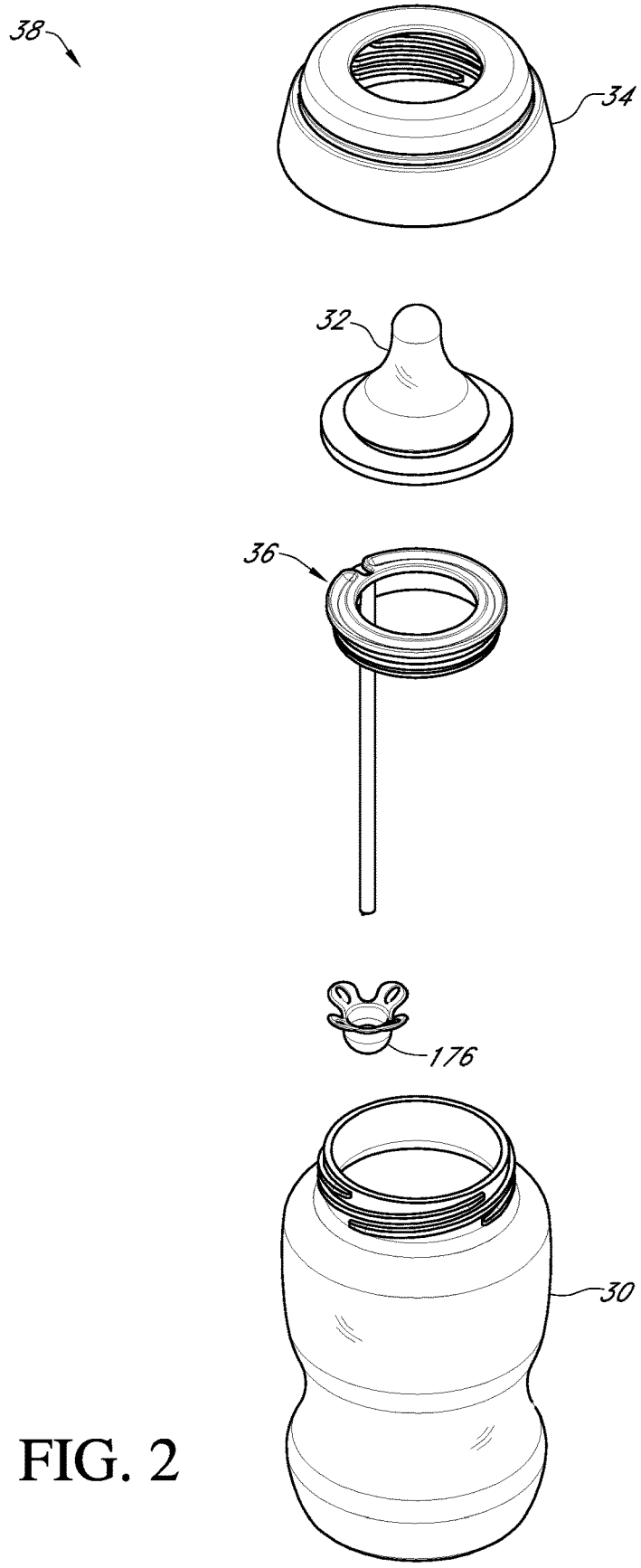
FIG. 2 is an exploded view of the vented baby bottle shown in FIG. 1.
Figure 3:
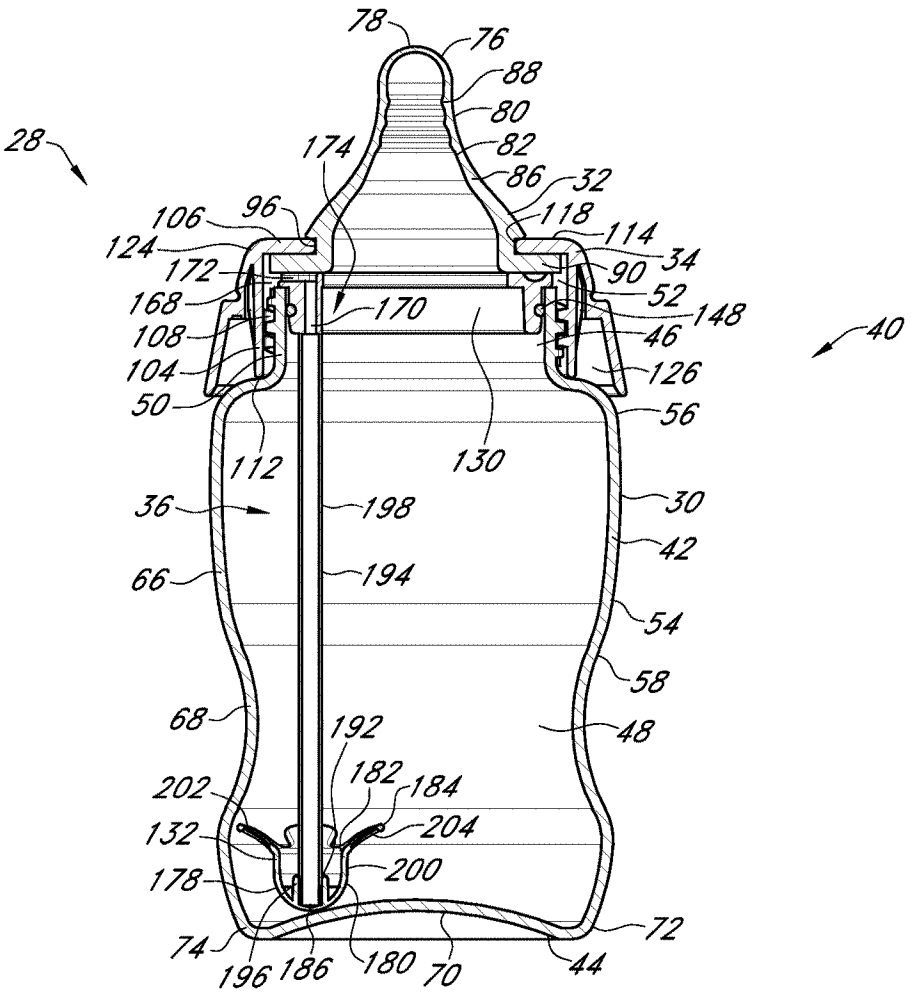
FIG. 3 is a cross sectional view of the vented baby bottle shown in FIG. 1, taken at section 3-3 of FIG. 5.
Figure 4:
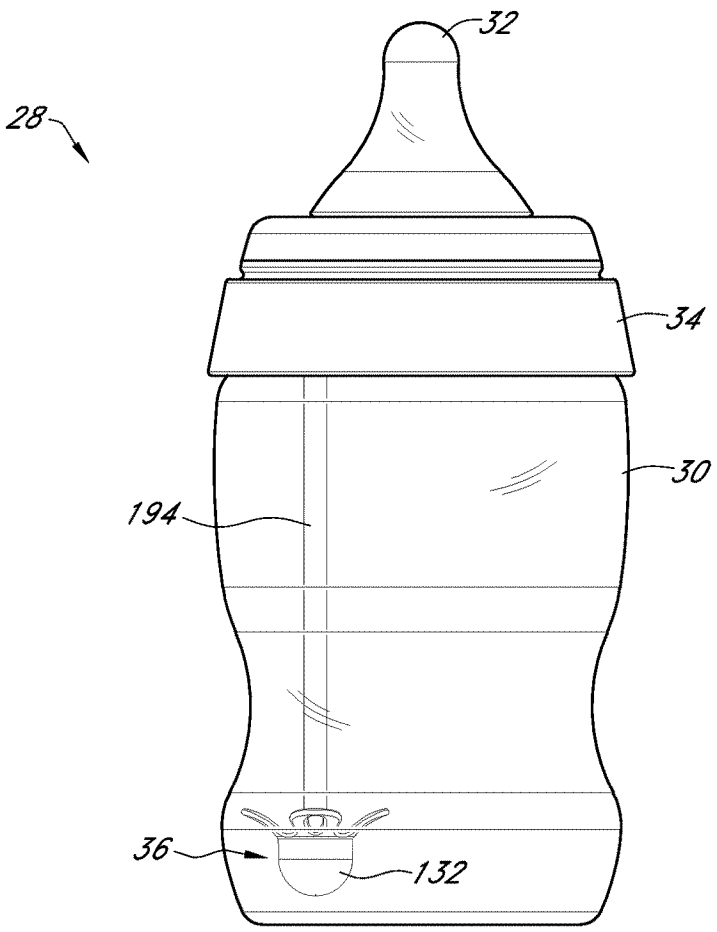
FIG. 4 is a side view of the vented baby bottle shown in FIG. 1.
Figure 5:
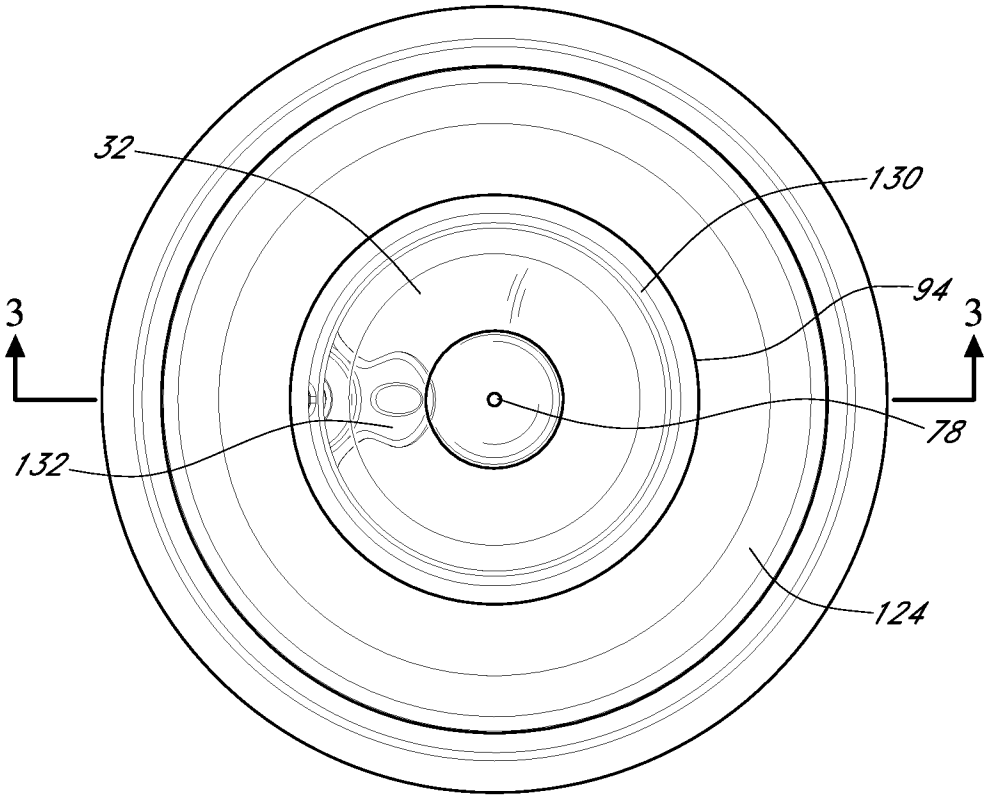
FIG. 5 is a top view of the vented baby bottle shown in FIG. 1.
Figure 6:
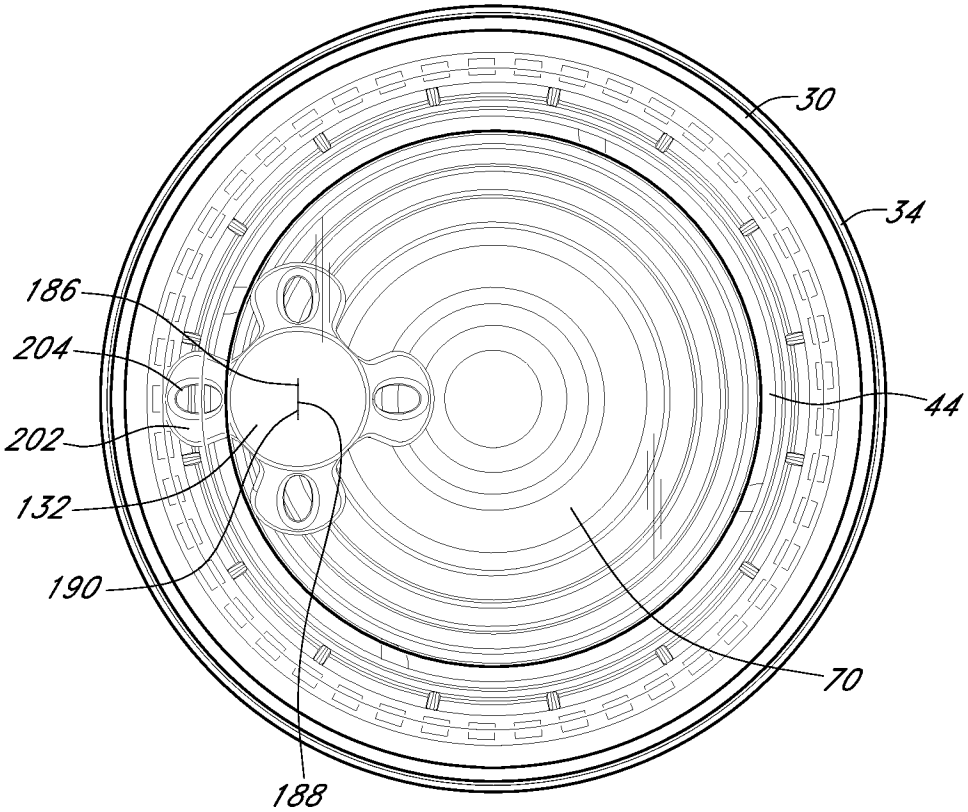
FIG. 6 is a bottom view of the vented baby bottle shown in FIG. 1.

A first preferred embodiment of a vented baby bottle 28 is shown in FIGS. 1-13, and comprises a bottle 30, a nipple 32, a mounting ring 34, and a vent assembly 36. The components of the first embodiment are shown in an exploded view 38 in FIG. 2 and in a cross sectional view 40 taken at plane 1-1-1 in FIG. 1.

One form of a bottle 30 for use with the invention is best shown in FIGS. 1-4 and FIG. 6, and is a rigid or semi-rigid container for holding a liquid. In one preferred form of the invention, the bottle 30 is a hollow container having generally cylindrical sidewalls 42, a base portion 44, and a single circular opening 46 into the interior 48 of the container. This opening 46 is preferably located at the top 50 of the bottle 30, is narrower in diameter 52 than that of the bottle's body 54 portion and contains a radiused shoulder 56 transitioning between the opening 46 and sidewall 42. The exterior portion 58 of the opening 46 further comprises a retention feature 60 for affixing the mounting ring 34 to the bottle 30. In one preferred form of the invention, the retention feature 60 is a set of external threads 62, and the interior of the bottle's opening 46 contain a smooth wall 64 for sealing and retaining the vent assembly 36. However, other retention features 60 for retaining the mounting ring and vent assembly to the bottle 30 are known in the art, and may also be suitably adapted for use with this system. Some alternate retention features 60 include crimping on a metallic mounting ring 34, or affixing a Lightning type wire and bale closure to the bottle 30.

The bottle 30 may also include side walls 66 which are formed with rounded features 68 which strengthen the sidewall 66 against flexure and further aid the infant in grasping the bottle 30. Additionally, the base portion 44 contains a concave surface 70 which strengthens the bottle against impact loads. The transitions 72 between the base 44 and the sidewall 42 are radiused 74 to remove any sharp edges, and the preferred material for the construction of the bottle is polypropylene, though similar materials may be substituted.

Figure 13:
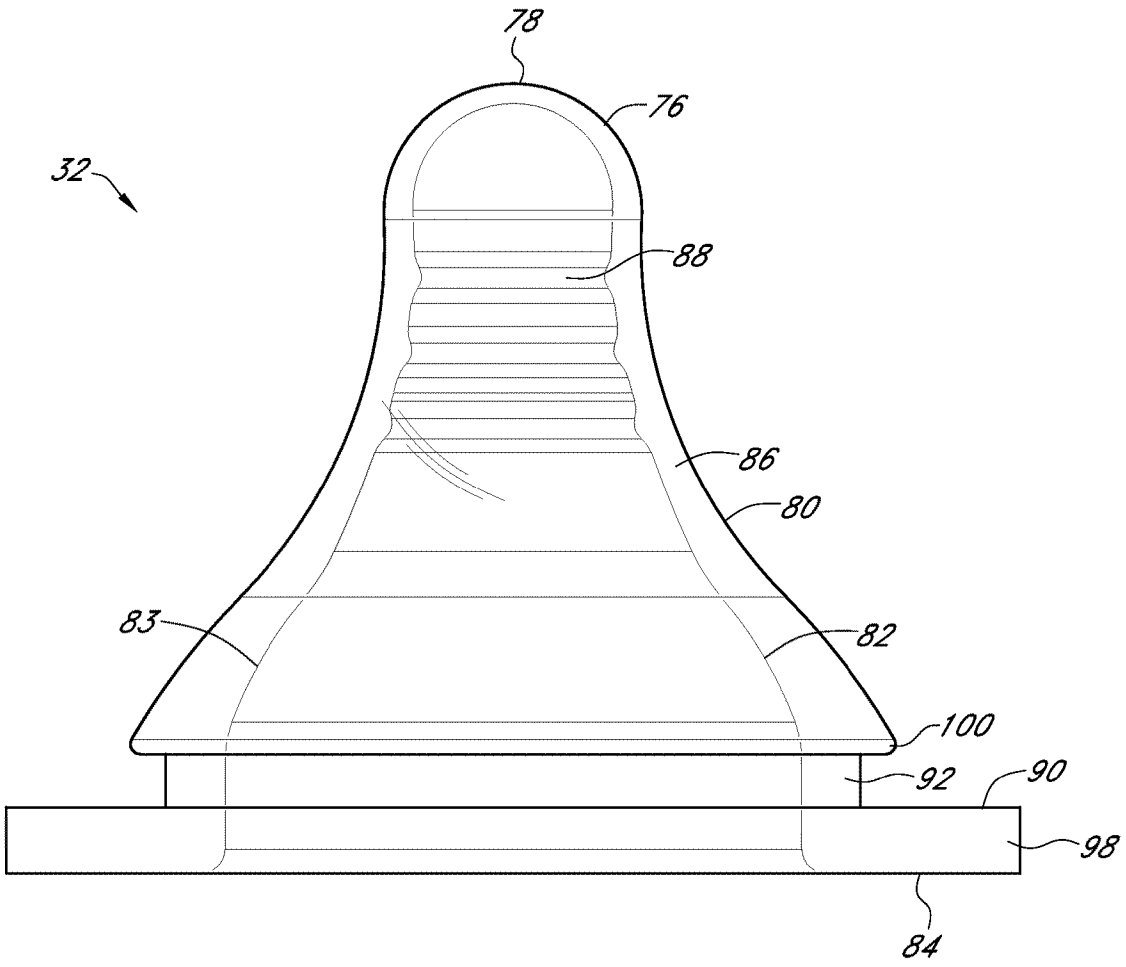
FIG. 13 is a side view of one preferred form of a nipple.
Figure 14:
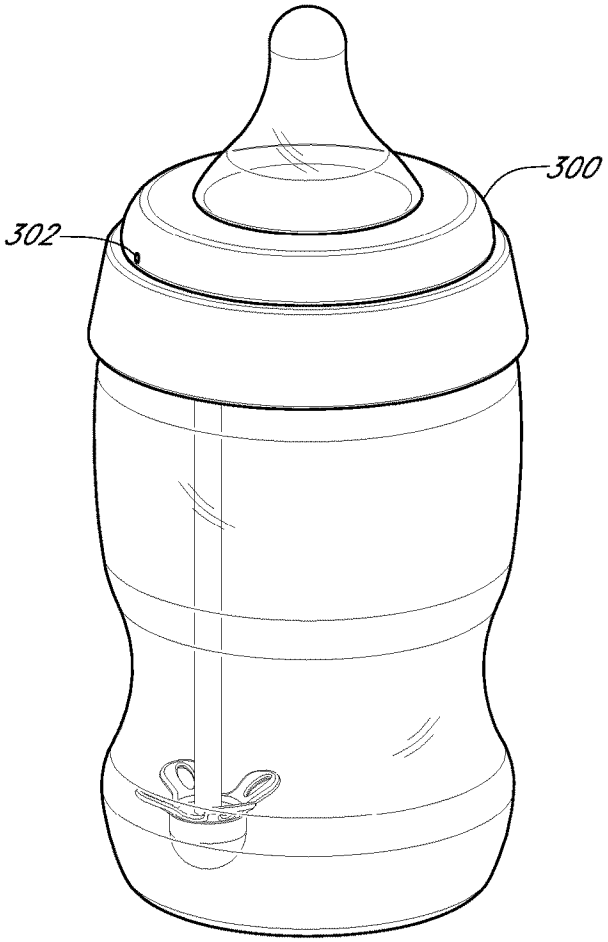
FIG. 14 is a perspective view of a second preferred form of a vented baby bottle.
Figure 15:
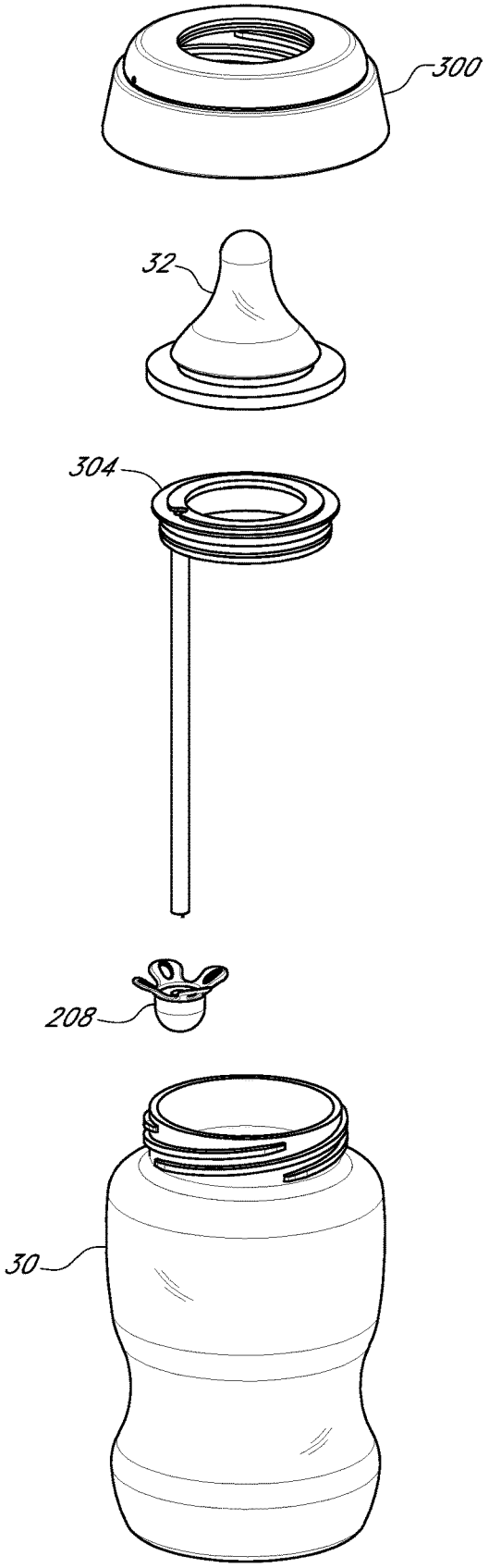
FIG. 15 is an exploded view of the vented baby bottle shown in FIG. 14.
Figure 16:
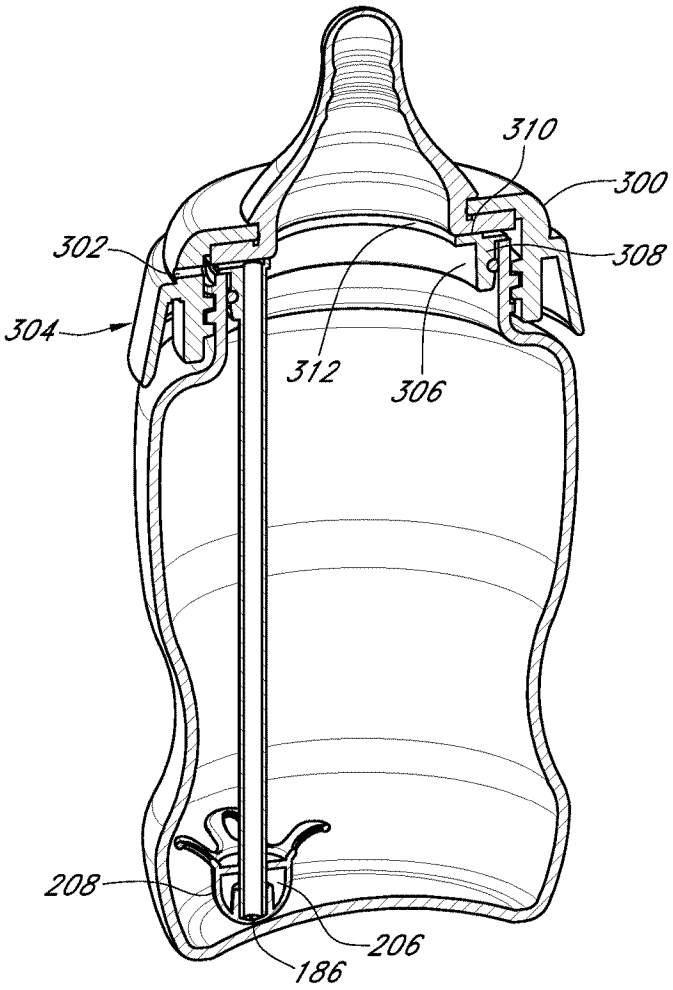
FIG. 16 is a cross sectional view of the vented baby bottle shown in FIG. 14 taken at section 3-3 of FIG. 5.
Figure 17:
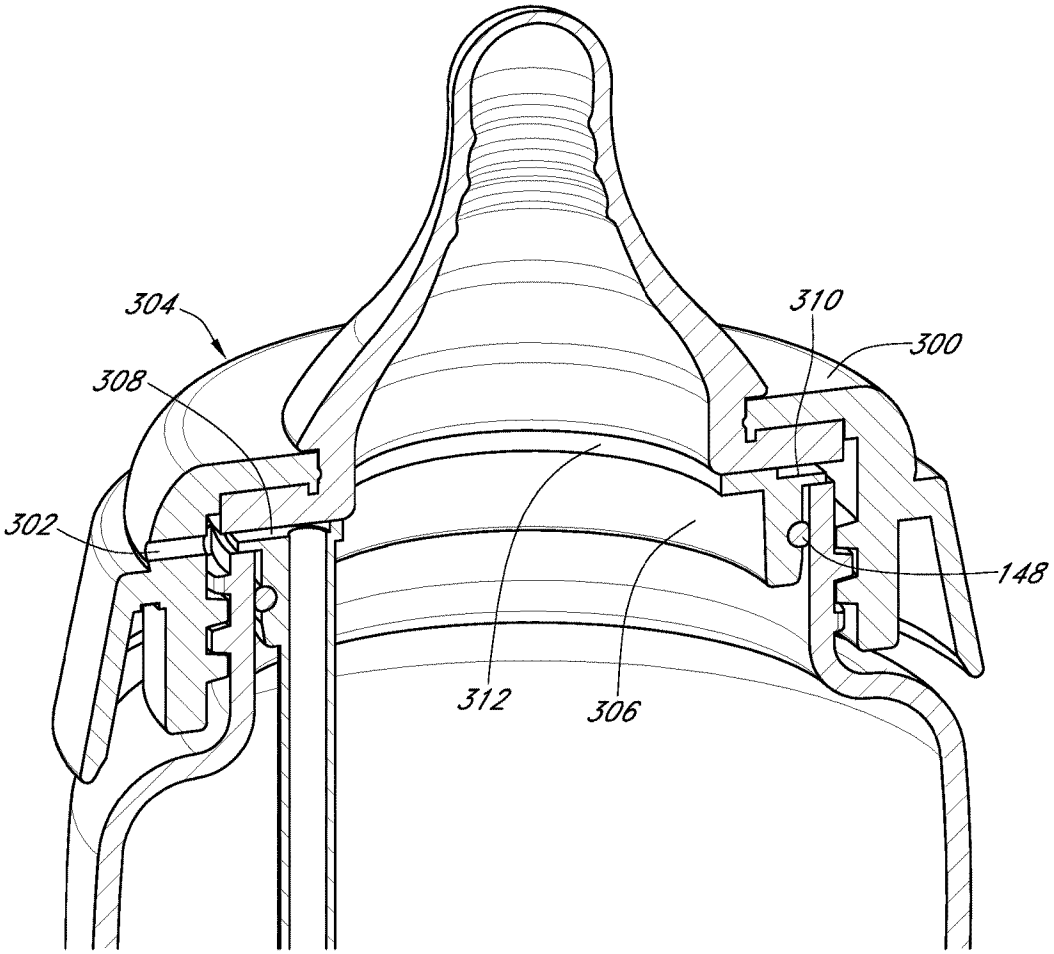
FIG. 17 is an enlarged view of FIG. 16, detailing the bottle, the vent assembly, the nipple, and the mounting ring of the second preferred form of the vented baby bottle.
Figure 18:
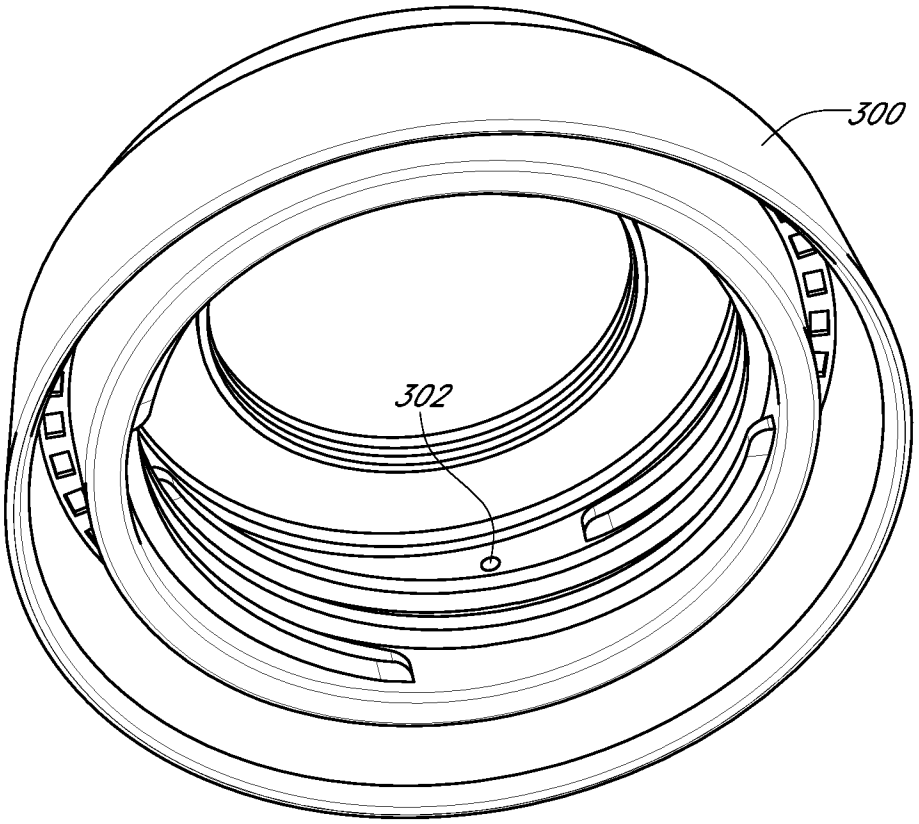
FIG. 18 is a perspective view of the mounting ring shown in FIG. 14.
Figure 19:
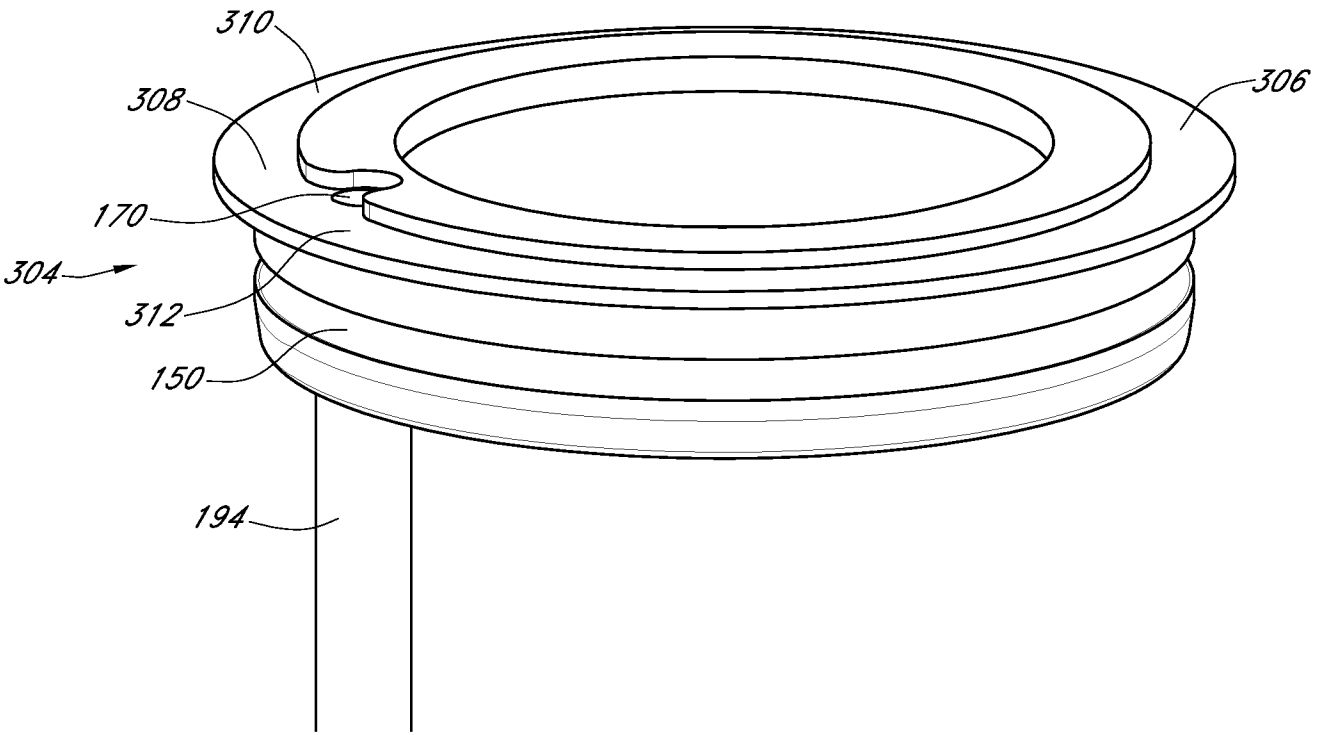
FIG. 19 is a perspective view of the vent ring shown in FIG. 15.

One form of a nipple 32 is shown in FIGS. 1-4, FIG. 7 and in detail in FIG. 13. The nipple 32 comprises a pliable top portion 76 which is shaped to emulate a human breast and further includes a dispensing orifice 78 passing from an exterior surface 80 to the interior surface 82 of the nipple 32. Opposite the top portion of the nipple is a base portion 84 which is shaped to aid the retention of the nipple 32 to the bottle 30. The nipple is preferably shaped as structure having hollow interior cavity 83 formed with a varying wall thickness 86. The interior surface 82 of the nipple 32 may also contain ribbing 88 which prevents the collapse of the nipple when in use.

The base portion 84 of the nipple 32 also preferably includes a retention feature 90 which in one form of the invention comprises a slot 92 passing circumferentially around the nipple 32. This slot 92 is sized to mate with the mounting ring 34 and is preferably sized to match the diameter of an opening 94 in the mounting ring 34. The width of the slot 92 is preferably sized to match that of the material thickness 96 at the mounting ring's opening 94. Further, the retention feature 90 may also include a flange portion 98 near the base 84 of the nipple 32. This flange portion is preferably sized to prevent the entirety of the nipple from passing through the mounting ring 34, and lies flush with a surface of the mounting ring 34. One preferred form of the nipple 32 may also include a ridge 100 that is adjacent to the slot 92. This ridge 100 is designed to be passed through the opening 94 of the mounting ring 34 engaging a surface of the mounting ring 34 opposite the surface engaged by the flange potion 98 of the nipple. This ridge and flange combination retains the nipple 32 on the mounting ring 34. A preferred material for the nipple is silicone, though other materials may be suitable for use with this invention.

Figure 7:
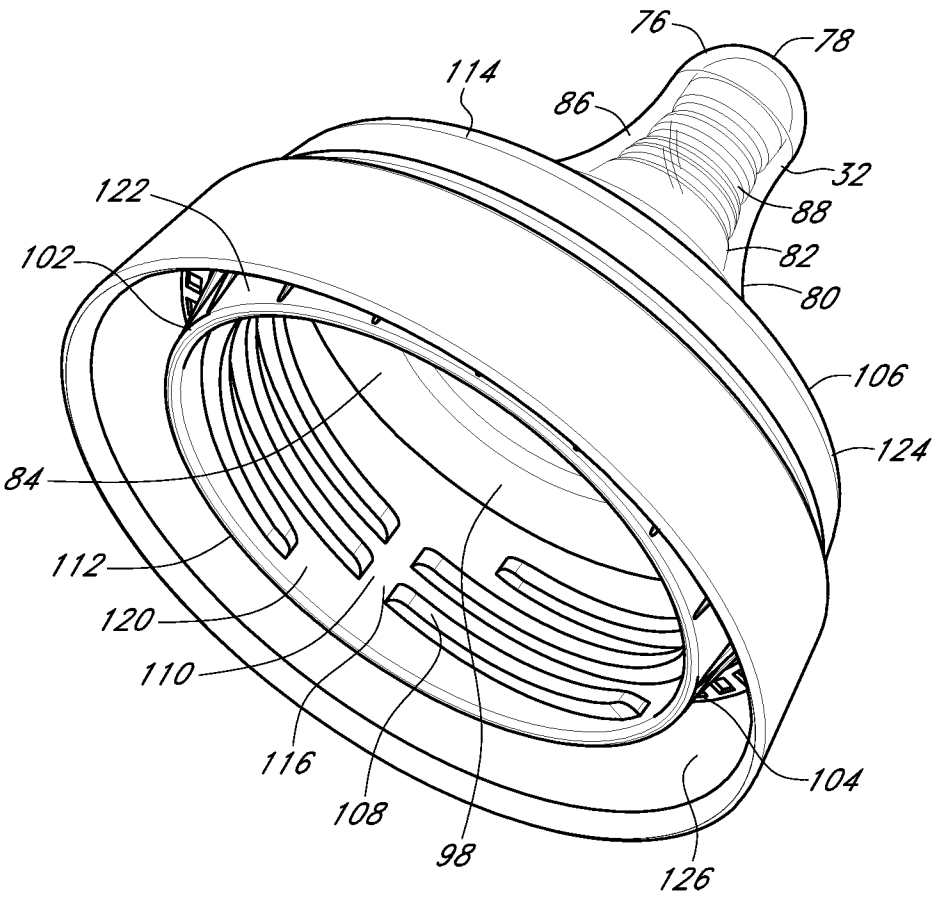
FIG. 7 is a perspective view of a nipple fitted to the mounting ring as shown in FIG. 1.

One form of a mounting ring 34 for use with the invention is shown in FIGS. 1-5 and in detail in FIG. 7 and comprises a cylindrical shaped ring 102 having a sidewall 104 and a flanged top 106. The sidewall is sized diametrically to mate with the top 50 of the bottle 30 and comprises interrupted threads 108, which are shaped to engage with the threads 62 of the bottle 30. These threads further contain at least one interruption 110 passing from the base 112 of the ring to the top 114 of the ring 34 forming an air passage 116 in the interruption. The flanged top 106 further comprises an opening 118 that is sized to mate with the nipple's flange 98 and slot 92. The mounting ring's flanged top 106 has an interior surface 120, which is sized to engage and compress the nipple's flange 98 against either the bottle 30 or the vent assembly 36 sealing the container and preventing liquids from exiting the bottle except through the dispensing orifice 78 in the nipple 32.

In one preferred form of the mounting ring 34, the exterior surface 172 of the mounting ring contains gentle radiuses 124 so as to present no sharp edges to the user of the vented baby bottle 28. The mounting ring 34 may further include a slot or recess 126 able to receive and retain optional features such as handles 128 for grasping the bottle 28. The preferred material for the mounting ring 34 is polypropylene though similar materials may be substituted.

Figure 8:
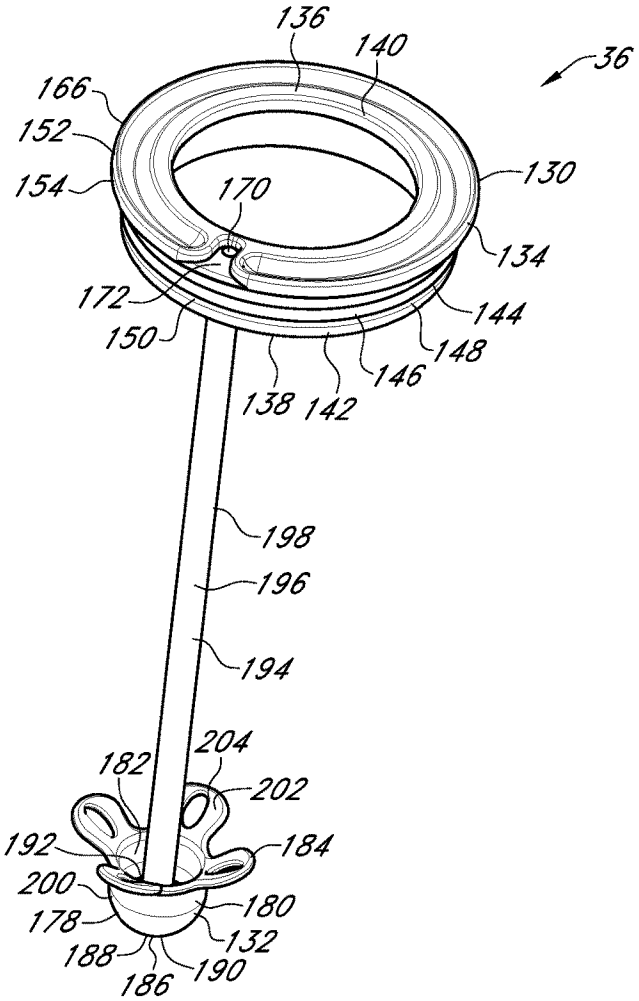
FIG. 8 is a perspective view of a first preferred form of a vent assembly.
Figure 9:
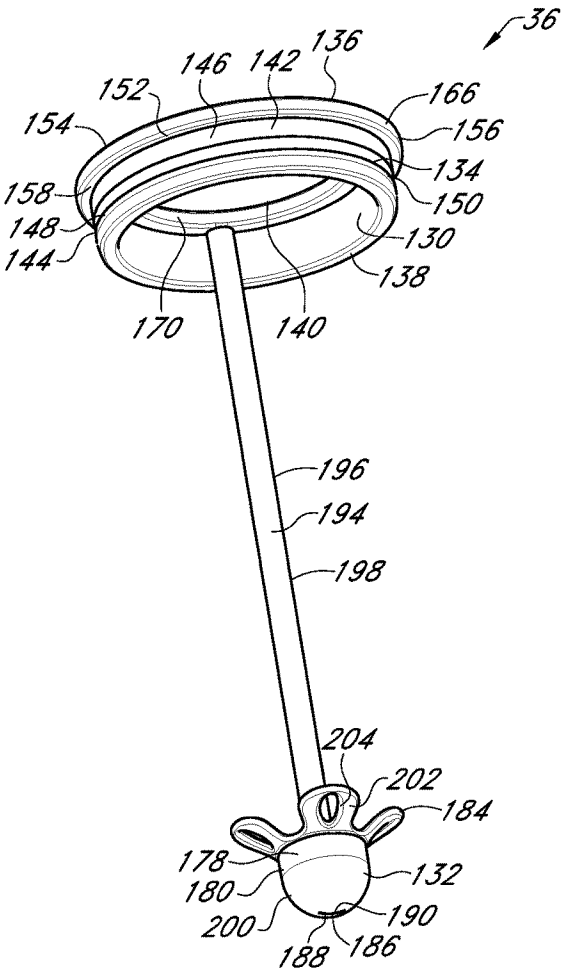
FIG. 9 is another perspective view of the vent assembly shown in FIG. 8.
Figure 10:
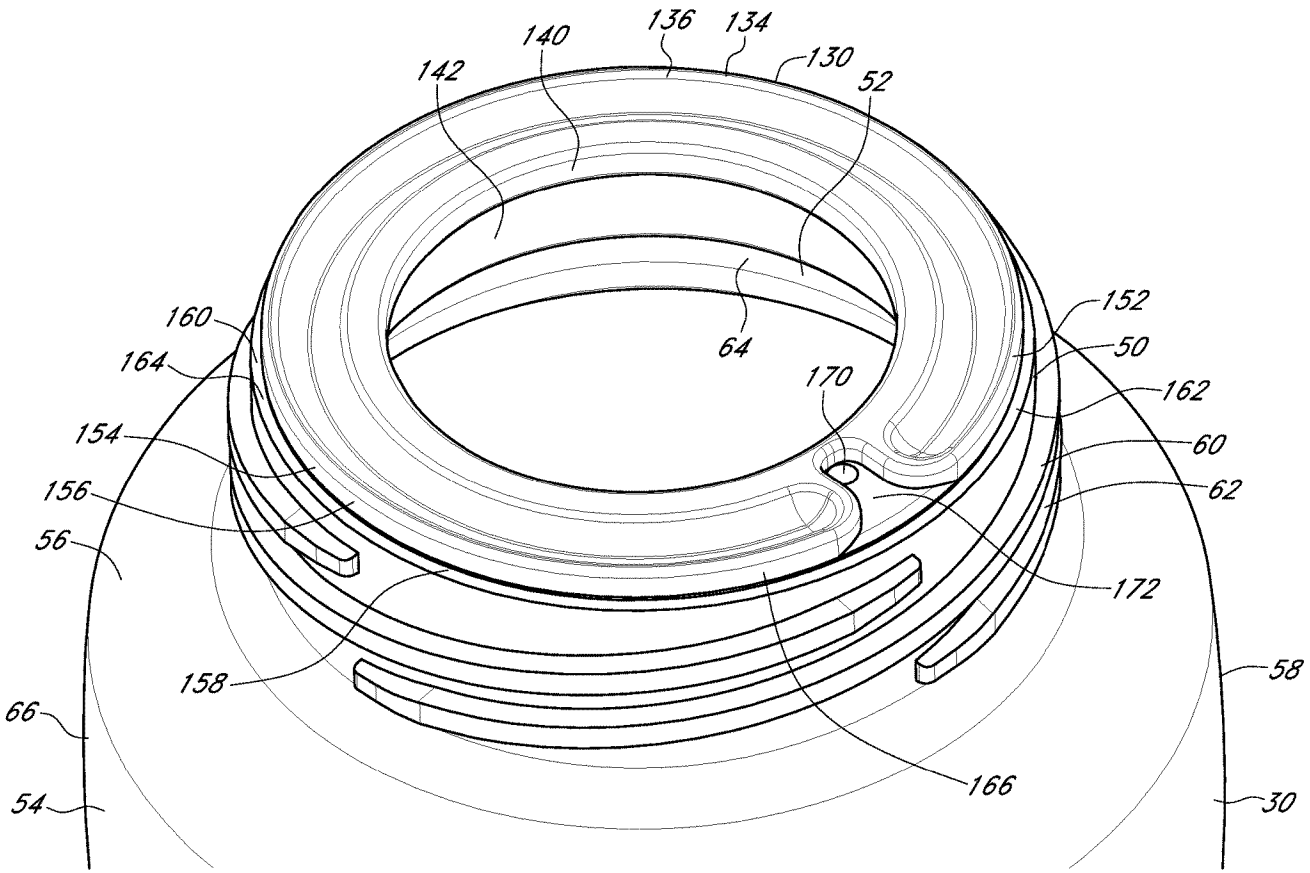
FIG. 10 is a perspective view of the vent assembly shown in FIG. 8, fitted to a bottle.

A first form of a vent assembly 36 is best shown in FIGS. 1-4 and in particular detail in FIGS. 8-10. The vent assembly 36 comprises a vent ring 130 and a vent valve 132 which allows air to pass from outside of the bottle 30 into the interior of the bottle 48, while preventing any liquid contained within the bottle from exiting through the vent.

One form of a vent ring 130 is shown in FIGS. 8-10 and comprises an annular shaped body 134, having a top 136 and bottom surface 138. A liquid passage 140, is preferably placed in the central region of the ring, and allows liquids contained within the bottle 30 to pass through the vent ring 130 to the nipple 32, allowing the user to withdraw the liquid contents from within the bottle.

The body 142 of the vent ring 130 is sized to mate with the interior 48 of the opening 46 in the bottle's 30 top 50, and is preferably slightly smaller in diameter than the bottle's opening 46. In this embodiment, the vent ring is preferably constructed of polypropylene, though similar materials may be substituted.

The body portion 134 of the vent ring 130 may also be fitted with a seal 144 on its exterior 146 surface. A preferred form of the seal 144 is an O-Ring 148 which is fitted to a circumferential groove 150 in the exterior surface 146 of the vent ring 130. The body portion 134 of the vent ring 130 is sized to fit into the opening 46 in the bottle 30 retaining the vent ring 130 to the bottle 30 and preventing liquids within the container from bypassing the seal 144. In this embodiment, the seal 144 is preferably constructed of silicone or a thermoplastic elastomer.

On top of the body portion 142 of the vent ring 130 is a flange 152. The flange 152 has a flange thickness 156 and is diametrically sized such that its diameter 152 is greater than that of the opening 46 of the bottle 30, but less than that of the exterior diameter 52 of the external thread 62. This flange is best shown in FIG. 10, wherein the vent ring 130 is shown inserted into the bottle 30. In this figure, the lower surface 158 of the flange 152 is in contact with the bottle's top 50, and the vent ring 130 is shown fully inserted into the bottle's opening 46. Since the flange 152 is slightly smaller in diameter than the top of the bottle 30 there is a diametrical difference 160 between the flange's outer diameter 154 and the exterior diameter 162 of the top 50 of the bottle 30. This diametrical difference 160 creates a ledge 164 around the exterior 166 of the flange 152. When the mounting ring is affixed 34 over top of the vent ring 130, the ledge 164 is covered by the mounting ring 34 creating an air passage 168 which surrounds the flange. Access from this air passage 168 to the bottle 30 is created by placing a vent hole 170 through the vent ring's body 142 and providing access from the air passage 168 to the vent hole 170 via a channel 172. The channel and vent hole are best shown in FIG. 8.

When the bottle 30, vent ring 130, nipple 32 and mounting ring 34 are combined, a venting system 174 is created which allows atmospheric air to pass through the interruption 110 in the interrupted threads 108 of the mounting ring, enter the air passage 168 and pass through the channel 172 and vent hole 170 into the bottle 30; however, a structure such as a valve is needed to prevent liquids contents from exiting the bottle through the venting system.

Figure 11:
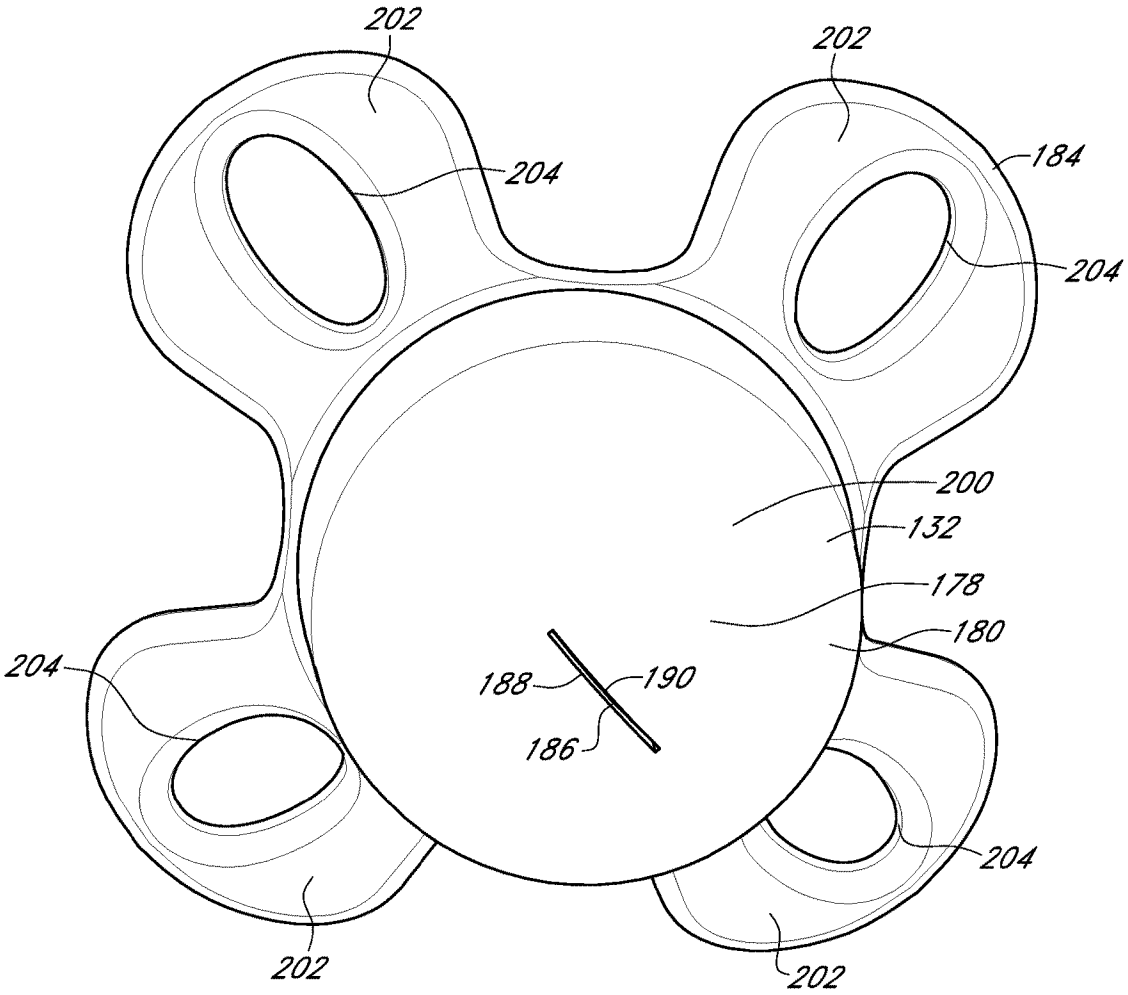
FIG. 11 is a perspective view of a preferred form of a vent valve.
Figure 12:
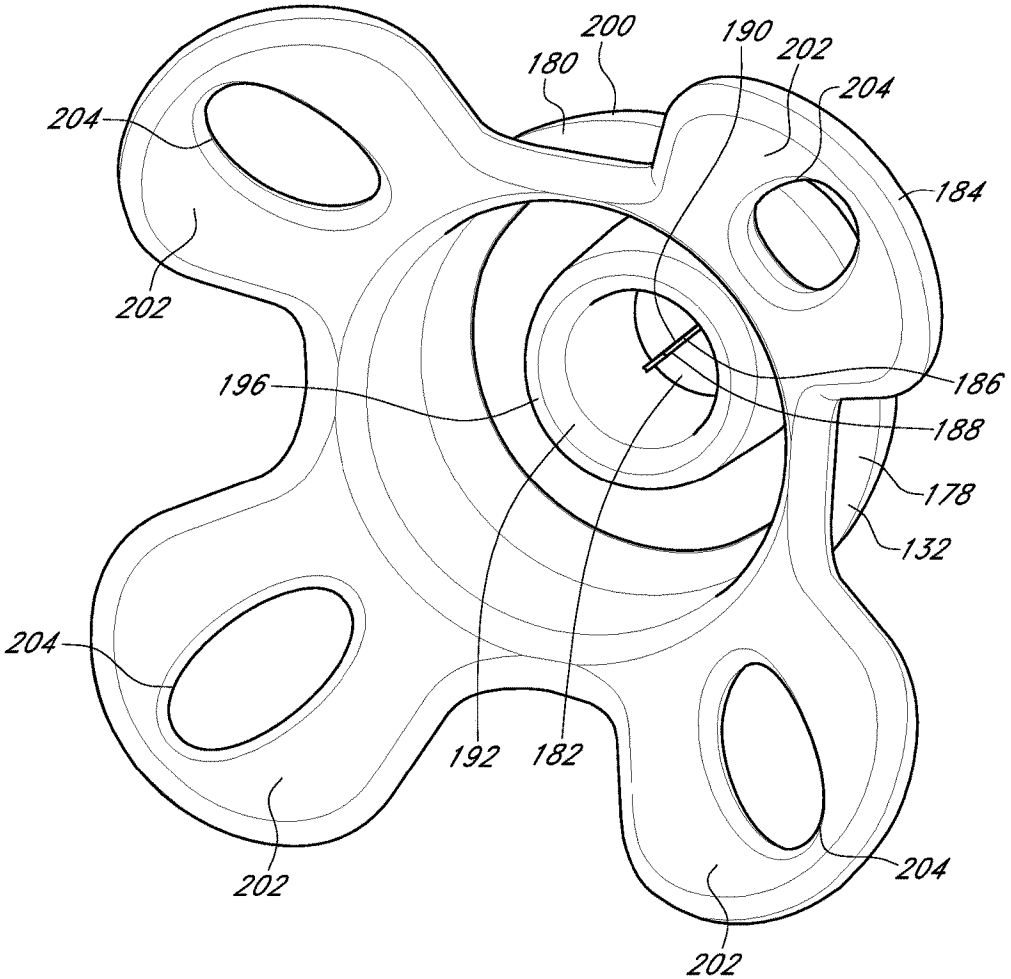
FIG. 12 is a perspective view of the reverse side of the vent valve shown in FIG. 11.

One form of a valve suitable for use with the system is a vent valve 132 as shown in FIGS. 11 and 12. The valve is preferably constructed of silicone, and comprises a deformable closure member 178 having an outer surface 180 and an inner surface 182 spaced apart by a material thickness 184. At least one dispensing slit 186 passes from the inner surface 182 to the outer surface 180 of the venting valve 132 forming a first 188 and second wall 190 within the slit 186. The deformable closure member 178 presses the first 188 and second 190 walls together when no load is applied to the structure, sealing the slit 186 and preventing the passage of liquids from the outer surface 180 to the inner surface 180 of the vent valve 132.

The vent valve 132 further contains an attachment structure 192 for mounting the valve to the mounting ring 34, preferably via a hollow vent tube 194 passing between the vent hole 170 in the vent ring 130, and the attachment structure 192 of the vent valve 132. In the embodiment shown in FIG. 12, the attachment structure is depicted as a cylindrical protrusion 196 sized to mate with the outer diameter 198 of the vent tube 194. The parts are preferably assembled by fitting the vent valve 132 onto the vent tube 194 which is in turn placed into the vent hole 170 of the vent ring 130.

The vent valve 132 operates via a differential pressure created between atmosphere and the pressure within the bottle 30. As the pressure within the bottle 30 is lowered via the dispensing orifice 78, as occurs when an infant withdraws liquid from within the bottle, atmospheric pressure is provided though the mounting ring 34, to the vent ring 130, down the vent tube 194 and to the inner surface of the vent valve 182, within the attachment structure 192. The outer surface 180 of the vent valve 132 is exposed to the reduced pressure environment within the bottle 30. This differential pressure causes the first 188 and second walls 190 of the deformable closure member 178 to separate, allowing the slit 186 to open and atmospheric air to enter the bottle 30 through the vent valve 132. As the pressure equalizes, the pressure difference required to open the slit 186 is removed, allowing the deformable closure member 178 to force the first 188 and second 190 walls against each other closing the slit 186, and preventing liquids from entering the vent assembly.

The length, shape and diameter of the vent tube 194 is variable, as is the rigidity of the tube; however in one preferred form of the system, the vent tube 194 is constructed of a rigid polypropylene having a length sufficient to place the vent valve 132 into the base 44 of the bottle 30. Since most uses of a baby bottle involve the tipping or inversion of the bottle 30 during use, placement of the vent valve 132 into the bottom most portion of the container is desirable, as it minimizes aeration of the fluids contained within the bottle 30 as atmospheric air is added to the system. The vent valve 132 is ideally hemispherical in shape 200 to aid the functioning of the deformable closure member 178, as a hemispherical shape 200 better resists leakage during a pressure inversion. Pressure inversions are created when the pressure inside of the bottle 30 exceeds that of atmospheric pressure. A typical cause is when an infant chews on the nipple 32 pressurizing the container. In these instances, the first 188 and second walls 190 within the slit 186 of the hemispherical shape 200 are forced together by the pressure inversion, preventing leakage better than when compared to a slit placed into in a flat surface.

In other forms of the invention, the vent tube 194 may be semi rigid, or even flexible. In these instances, the vent valve 132 may also be modified either by adding a weight 206 or a float 208 to the vent valve 132, preferably on its interior surface 182. If a float 208 is added to the vent valve 132, the flexure of the vent tube 194 allows the vent valve to float on the surface of the liquid; thereby orienting the vent's slit 186 away from the liquids within the container. However, if a weight 206 is added to the vent valve in combination with a flexible vent tube, the vent valve 132 will tend to sink below the surface of the liquids within the bottle 30 maximizing its exposure with the liquid.

Additional features for the vent valve 132 may also include radial protrusions, preferably shaped as petals 202 formed onto the outer surface 180 of the vent valve 132. In the form of the invention shown in FIG. 11, the petals 202 increase the size of the vent valve 132, assisting compliance with the small parts regulation of the Consumer Products Safety Commission (16 C.F.R. Part 1501 and Part 1500.50-53), by enlarging the structure of the vent valve 132 to prevent ingestion by a child. In alternate forms of the invention, particularly where the vent tube 194 is not rigid, the petals 202 may be used prevent the vent valve's slit 186 from lying adjacent to the interior of the bottle 48, thereby assuring proper functionality. Additional passages 204 may be placed through the petals 202 to allow free flow of fluids within the bottle 30. Alternate embodiments of the vent valve include various one way and check valves, including spring loaded ball check valves and poppet valves. However, vent valves 132 including a deformable closure member 178 and a slit 180 are a preferred method of sealing the vent. This style of vent is preferred due to the ease of cleaning, lack of small parts, and the ability to fully sterilize the structure.

A second form of the vented baby bottle is shown in FIGS. 14-19 and modifies the venting ring 130 and vent assembly 36 in the following manner: The interrupted threads 108 are removed and replaced with an alternate mounting ring 300 having a hole 302. This hole 302 serves the purpose of the interrupted threads, and allows atmospheric air to pass through the alternate mounting ring 300 and move adjacent the alternate vent assembly 304. The alternate vent assembly 304 comprises an alternate venting ring 306 shown in FIG. 19, wherein the ledge 164 created by a diametrical difference between the flange and bottle diameters, is replaced with a molded air passage 308 on the top portion 310 of the alternate venting rings flange 312. Functionally, these systems are otherwise identical.

Figure 20:
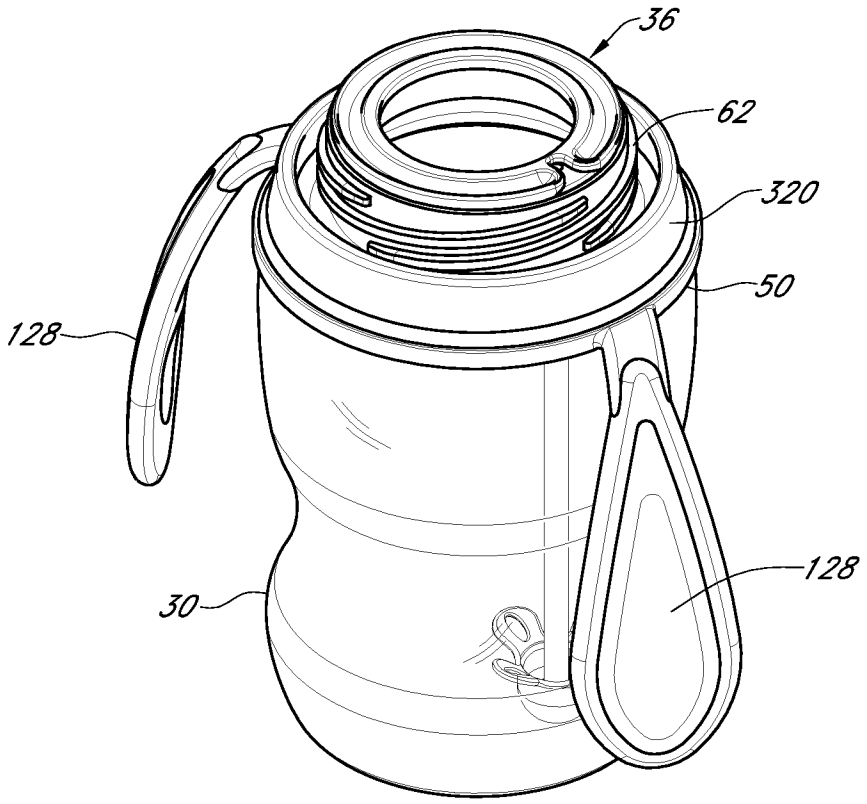
FIG. 20 is a perspective view of a pair of handles fitted to the vented baby bottle shown in FIG. 1, with the mounting ring and nipple removed.
Figure 21:
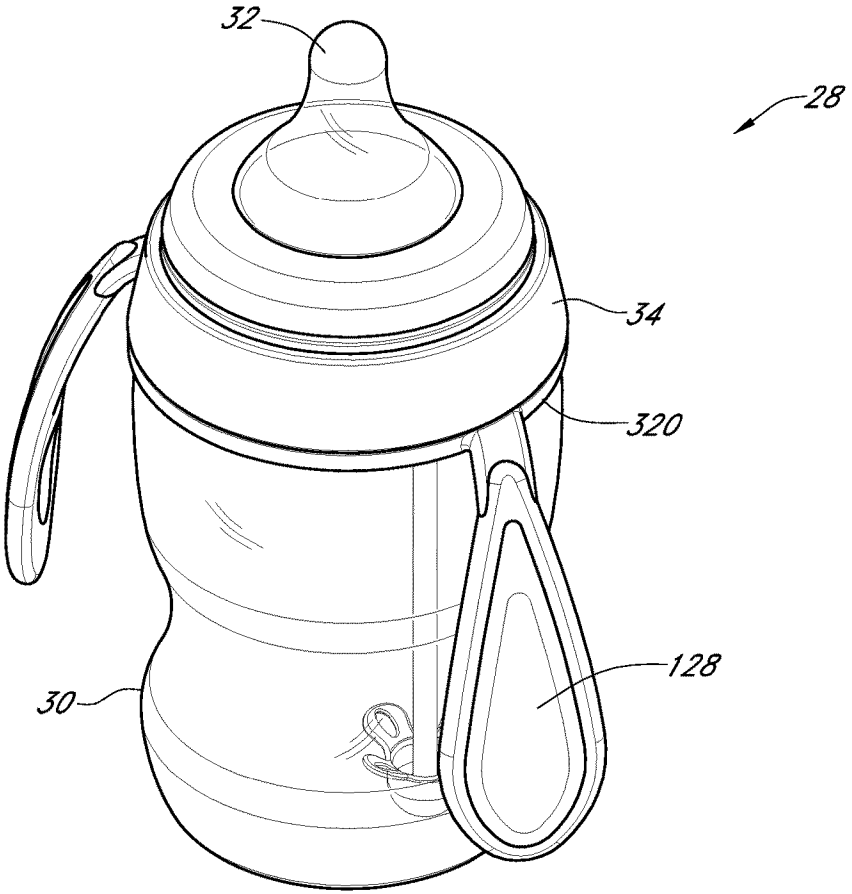
FIG. 21 is a perspective view of a pair of handles fitted to the vented baby bottle shown in FIG. 1.

Additional features may include handles 128 shown in FIGS. 20 and 21. In a preferred form of the invention, these handles may be mounted to an attachment ring 320 which fits into the recess 126 in the base 112 of the mounting ring 34. To mount the handles to the bottle 30, the attachment ring 320 is passed over the top 50 of the bottle 30. The mounting ring 34 is then affixed to the bottle, compressing the attachment ring 320 against the bottle, retaining the handles 128 in place.

Figure 22:
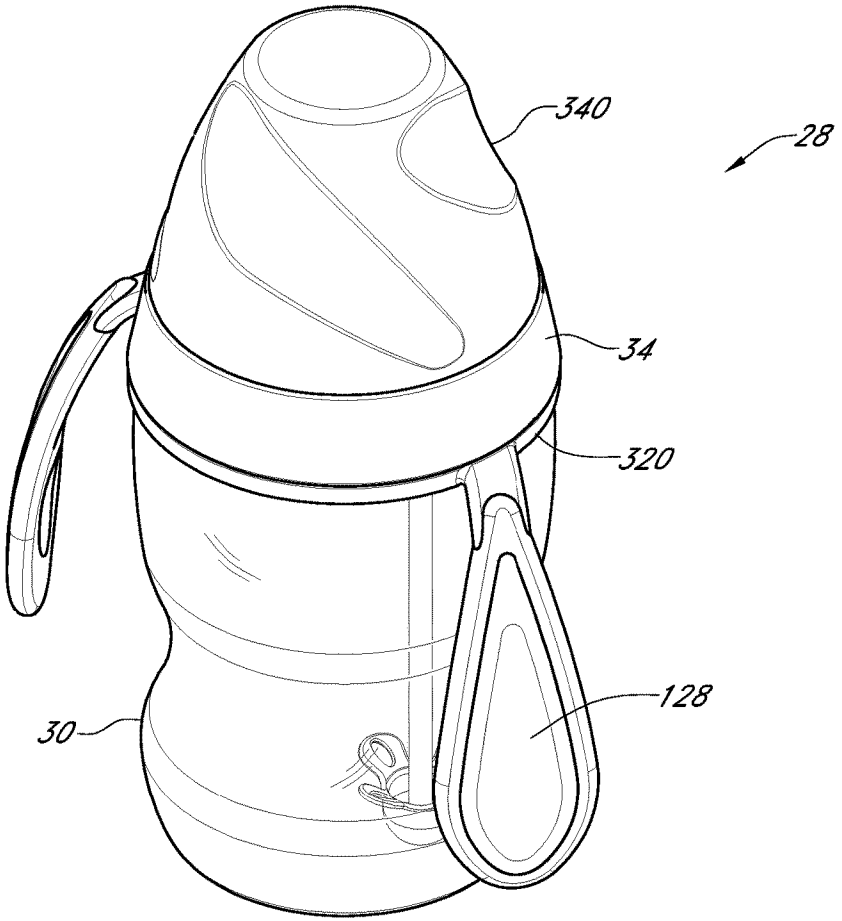
FIG. 22 is a perspective view of a cap fitted to the vented baby bottle shown in FIG. 21.

Another optional feature is a cap 340 shown in FIG. 22. The cap 340 is designed to be retained on the bottle via a transitional fit between the cap and the top 50 of the bottle 30. Caps are useful to prevent the nipple 32 from becoming contaminated.

The principle advantage offered by this invention includes an air passage through a mounting ring of a baby bottle into the interior of a bottle, allowing atmospheric air to pass through a self closing one way valve, thereby venting the interior of the baby bottle when a lower than atmospheric pressure is created within the bottle.

The above description is considered that of the preferred embodiments only. Modifications to the invention will occur to those skilled in the art and those who make use of the invention. Therefore, it is understood that the embodiments shown in the drawings and the examples set forth herein are described merely for illustrative purposes, and are not intended to limit the scope of the invention as interpreted according to the principles of patent law, including the doctrine of equivalents.

The invention claimed is:

1. An apparatus for venting a baby bottle, comprising:

a bottle forming a hollow container with an interior volume suitable for holding a liquid, said bottle having a single opening into said interior volume, said single opening located at a top portion, said single opening further having an interior diameter;

a nipple;

a mounting ring having a body portion and a flanged top, and an opening in said flanged top sized to receive and retain said nipple;

a vent assembly further comprising:

a vent ring having a body, a flange attached to said body, a vent hole and a liquid passage passing through said body; and a vent valve;

wherein when said body of said vent ring is fitted into said bottle, and when said flange is positioned adjacent to said top portion, an air passage is created allowing atmospheric air to pass diametrically along said flange into said vent hole, said air passage ending adjacent said vent valve;

wherein in a first position said vent valve is closed blocking said air passage;

wherein in a second position, said vent valve is opened allowing atmospheric air located in said air passage to enter said interior volume of said bottle;

wherein said vent valve is positioned from said first position to said second position by creating a lower than atmospheric pressure in said interior volume of the bottle;

wherein said top portion of said bottle is annular; said mounting ring is annular; said single opening into said interior volume is annular; and wherein said vent ring further comprises a cylindrical body and an annular flange, a circumferential groove placed into said cylindrical body, and an O-ring fitted to said circumferential groove.

2. The apparatus as defined in claim 1, further comprising:

a channel passing from an exterior surface of said annular flange to said vent hole.

3. The apparatus as defined in claim 1, wherein said vent valve further comprises:

an inner surface, an outer surface, a dispensing slit, and a deformable closure member;

wherein said dispensing slit passes between said inner surface and said outer surface forming a first wall and second wall within said dispensing slit.

4. The apparatus as defined in claim 3, wherein said vent valve further comprises:

a hemispherical shape.

5. The apparatus as defined in claim 4, wherein said hemispherical shaped vent valve further comprises one of the following: a float, or a weight.

6. The apparatus as defined in claim 3, further comprising:

an external thread on said annular top portion of said bottle;

an internal thread on said body portion of said mounting ring;

wherein said internal thread is sized to mate with said external thread; and wherein said annular flange is sized to be diametrically smaller than said external thread and sized to be diametrically larger than said single annular shaped opening.

7. The apparatus as defined in claim 6, wherein said internal thread further comprises an interruption passing from said body portion to a lower surface of said flanged top.

8. The apparatus as defined in claim 3, wherein said mounting ring further comprises:

a hole through said body portion of said mounting ring.

9. The apparatus as defined in claim 3, further comprising a vent tube.

10. The apparatus as defined in claim 9, wherein said vent tube extends into a base portion of said bottle.

11. The apparatus as defined in claim 9, wherein said vent tube is rigid.

12. The apparatus as defined in claim 9, wherein said vent tube is flexible.

13. The apparatus as defined in claim 9, wherein said vent valve further contains at least one radial protrusion.

14. The apparatus as defined in claim 13, wherein said vent valve further contains four petal shaped radial protrusions.

15. A method for making a vented baby bottle, comprising the steps of:

providing a bottle forming a hollow container having a top portion and an interior volume suitable for holding a liquid, said top portion further having an interior diameter;

providing a nipple;

providing an annular mounting ring having a body portion and a flanged top;

providing a vent assembly further comprising:

a vent ring having a body, a flange attached to said body, a vent hole passing through said body, a liquid passage passing through said body; and providing a vent valve;

fitting said body of said vent ring into said bottle until said flange is positioned adjacent to said top portion, thereby creating an air passage allowing atmospheric air to pass diametrically along said flange into said vent hole, said air passage ending adjacent said vent valve;

positioning said vent valve into a first position blocking said air passage;

positioning said vent valve into a second position, allowing atmospheric air located in said air passage to enter said interior volume of said bottle; and controlling the position of said vent valve via the differential pressure between atmospheric pressure and the pressure in said interior volume of said bottle.

16. The method as defined in claim 15, wherein:

the step of providing a vent valve further comprises the step of providing a hemispherical shaped vent valve having an inner surface, an outer surface, a dispensing slit, and a deformable closure member; wherein said dispensing slit passes between said inner surface and said outer surface forming a first wall and second wall within said dispensing slit;

the step of positioning said vent valve into a first position blocking said air passage further comprises placing said first wall and said second wall of said dispensing slit into contact with one another;

the step of positioning said vent valve into a second position further comprises separating said first wall and said second wall of said dispensing slit by deforming said deformable closure; and the step of controlling the position of said vent valve further comprises using said differential pressure between atmospheric pressure and the pressure in said interior volume of said bottle to deform said deformable closure, positioning said vent valve from said first position to said second position.

17. An apparatus for venting a baby bottle, comprising:

a bottle having a concave base portion, curved side walls, and an annular top portion forming a hollow container with an interior volume, suitable for holding a liquid, said annular top portion further having an external thread, and a single annular shaped opening into said interior volume of said bottle, said annular opening further having an interior diameter with a smooth wall;

a nipple, constructed of supple material, having a tip, a midsection, and a flanged base, said nipple having a cavity extending from an interior portion of said tip, through said midsection and passing through said flanged base, said tip further comprising a dispensing orifice passing from said cavity through said tip to an exterior surface of said nipple;

an annular mounting ring having a body portion and a flanged top, said body portion further having an internal thread sized to mate with said external thread on said bottle, said internal thread further having a interruption passing from said body portion to a lower surface of said flanged top, wherein said flanged top further comprises an opening sized to receive and retain said nipple;

a vent assembly further comprising:

a vent ring having a cylindrical body with a circumferential groove and an o-ring fitted to said circumferential groove, an annular flange attached to said cylindrical body, a vent hole passing through said cylindrical body, a channel passing from an exterior surface of said annular flange to said vent hole, a cylindrical shaped liquid passage passing through the center of said cylindrical body and said annular flange, wherein said annular flange is sized to be diametrically smaller than said external threads and sized to be diametrically larger than said singular annular shaped opening creating a diametrical difference between said annular flange and said external threads;

a hemispherical shaped vent valve having an inner surface, an outer surface, a dispensing slit, a deformable closure member, and at least one petal shaped protrusion; wherein said dispensing slit passes between said inner surface and said outer surface forming a first wall and second wall within said dispensing slit; and a rigid vent tube having an inner diameter and sized to extend into said base portion of said bottle when assembled, wherein said rigid vent tube is affixed to said vent ring adjacent said vent hole, and wherein said rigid vent tube is affixed to said hemispherical shaped vent valve adjacent to said dispensing slit;

wherein when said cylindrical body of said vent ring is fitted into said single annular shaped opening, when said annular flange is positioned adjacent to said annular top portion, and when said internal threads are mated to said external threads, an air passage is created allowing atmospheric air to pass: through said interruption in said internal threads in said mounting ring; pass along said diametrical difference between said annular flange and said external threads; pass through said channel and into said vent hole; and pass through said inner diameter of said vent tube, said air passage ending adjacent said interior surface of said dispensing slit in said vent valve;

wherein in a first position, said first wall and said second wall of said dispensing slit are placed into contact with one another by said deformable closure;

wherein in a second position, said first wall and said second wall of said dispensing slit are separated through the deformation of said deformable closure, thereby allowing atmospheric air located in said air passage to enter said interior volume of said bottle; and wherein said deformable closure is positioned from said first position to said second position by creating a lower than atmospheric pressure in said interior volume of said bottle.

18. The apparatus as defined in claim 17, further comprising a handle mating with a recess in said mounting ring.

19. The apparatus as defined in claim 1, wherein said vent hole is located between said top portion of the bottle and said nipple.

20. The apparatus as defined in claim 1, wherein atmospheric air passes diametrically along said flange in an air passage located between said nipple and said top portion of the bottle.

* * * * *